United States Patent [19]

Suzuki

[11] 3,963,304

[45] June 15, 1976

[54] ARC-SPLITTING FIN TYPE SCREW SET

[76] Inventor: Eiji Suzuki, 22-11, Kamiyamacho, Shibuya, Tokyo, Japan

[22] Filed: Feb. 20, 1975

[21] Appl. No.: 551,574

[30] Foreign Application Priority Data

Mar. 9, 1974 Japan ..... 49-26776

[52] U.S. Cl. ..... 339/245; 151/34

[51] Int. Cl.[2] ..... H01R 7/06

[58] Field of Search ..... 339/245; 151/34, 40, 151/41

[56] References Cited

UNITED STATES PATENTS

| | | | |
|---|---|---|---|
| 2,360,274 | 10/1944 | Rapp | 151/34 |

FOREIGN PATENTS OR APPLICATIONS

| | | | |
|---|---|---|---|
| 428,990 | 5/1926 | Germany | 339/245 |
| 166,648 | 8/1950 | Germany | 339/245 |
| 1,043,843 | 9/1966 | United Kingdom | 151/34 |

*Primary Examiner*—Roy Lake
*Assistant Examiner*—Mark S. Bicks
*Attorney, Agent, or Firm*—Bauer, Amer & King

[57] ABSTRACT

A threaded coupling in which a first disc element is formed with a discontinuous internal thread and a second disc element is formed with a cooperable discontinuous external thread. The coupling includes a mounting plate element juxtaposed adjacent the disc element. Aligned openings are provided in the plate, disc and mounting block elements. A stud element completes the coupling and is rotatably mounted within the opening in the mounting block element but is provided with a depending projection which engages within the opening in the disc element. Rotation of the stud element thus threads the disc element into the plate element to provide a unitary assembly. Rotation of the stud element in the other direction unthreads the disc element and uncouples the assembly.

12 Claims, 7 Drawing Figures

C
28
27
20b 25
26
29
30
35
32
20

31
21a
20a
23
23a
21
22
22
22a
23

23
24
23a
22a
22
13
13a
15
12
12
12a 13a
13
14
10
14
12a
11
13
C

ARC-SPLITTING FIN TYPE SCREW SET

BACKGROUND OF THE INVENTION:

It is well-known that threaded couplings are effective under restricted space conditions where the vertical space available for coupling an object is limited. In the conventional screw-type couplings designed for use under such restricted space conditions, a lamellar screw or discontinuous screw formed from a lamellar block by a drill press or similar means was used only for the female or internal threaded member. Since the flight depth of the internal thread is the same as that of the ordinary angular screws, the pressure-carrying contact area between both internal and external threads, which is directly effective for screw fixing, was very limited, and hence there arose a possibility of disengagement or improper engagement of threads due to tension load or bending load or loosening of thread engagement due to vibrating loads. This jeopardized or prevented the secure fixing of the object. Also, if a separate attachment fitting such as a washer is provided for detent means, it could become impossible to conform the entire assembly to the restricted space condition such as above-mentioned. It is also apparent that the above- problems can not be corrected if an ordinary angular thread is used for both of the internal and external threaded members. Further, the use of other securing techniques such as rivetting involves the need for specific tool (or tools) or highly skilled technique for maintenance, inspection, repair and detachment when such are required.

It is an object of the present invention to provide a screw-type coupling for fixing an object in a desired position, and more particularly to a threaded coupling of the discontinuous type.

An object of the present invention is to provide a threaded coupling of the character described which permits utilization of an increased pressure-sustaining area for threading while conforming to the requirements of the restricted space conditions such as aforementiond.

Another object of the present invention is to provide a threaded coupling which can be operated with ease even by an inexperienced person with a single commonly used screw driver as the only operating tool.

Still another object of the present invention is to provide a threaded coupling which necessitates no separate detent means.

SUMMARY OF THE INVENTION split to the present invention, each of the internal and external threaded members is made from a plate splite into a plurality of arcuate fins. The plate may for instance be formed from a single block by a drill press of the like such that the securing force is sustained by the plate surface contact. Also, a stud-like columnar body is secured vertically in the center of the externally threaded plate and is loosely fitted in a hole formed in a mounting block such that said mounting block is restricted in its movement in the axial direction of the columnar body or stud by the enlarged head portion of said stud which is provided with a slotted head surface for receiving a turning tool such as a screw driver. As detent means, there are provided indentations designed for elastically holding at least one of said plates and also for permitting engagement of the pressure-sustaining contact surfaces of said both plates.

Also, according to the present invention, if the object to be fixed itself is a plate or plate-like body, such plate or plate-like body can be immediately utilized in place of the internally threaded plate. The mounting block may be also a plate. The coupling of the present invention proves better adaptable to the most strict space requirements when both the mounting block and object to be mounted are plates. Further, since the phrases "mounting" and "to be mounted" have, in most cases, only a relative meaning, they are practically interchangeable with each other.

The other objects and advantages of the present invention will become apparent from the following detailed description and drawings showing a preferred embodiment of the present invention.

PREFERRED EMBODIMENT OF THE INVENTION:

In FIGS. 1*a* to 1*d*, there are shown in an exploded perspective view the component elements of the present invention as they are separated along the axial line C-C of the screw set (stud assembly).

Figures 1A, 1B, 1C, 1D:
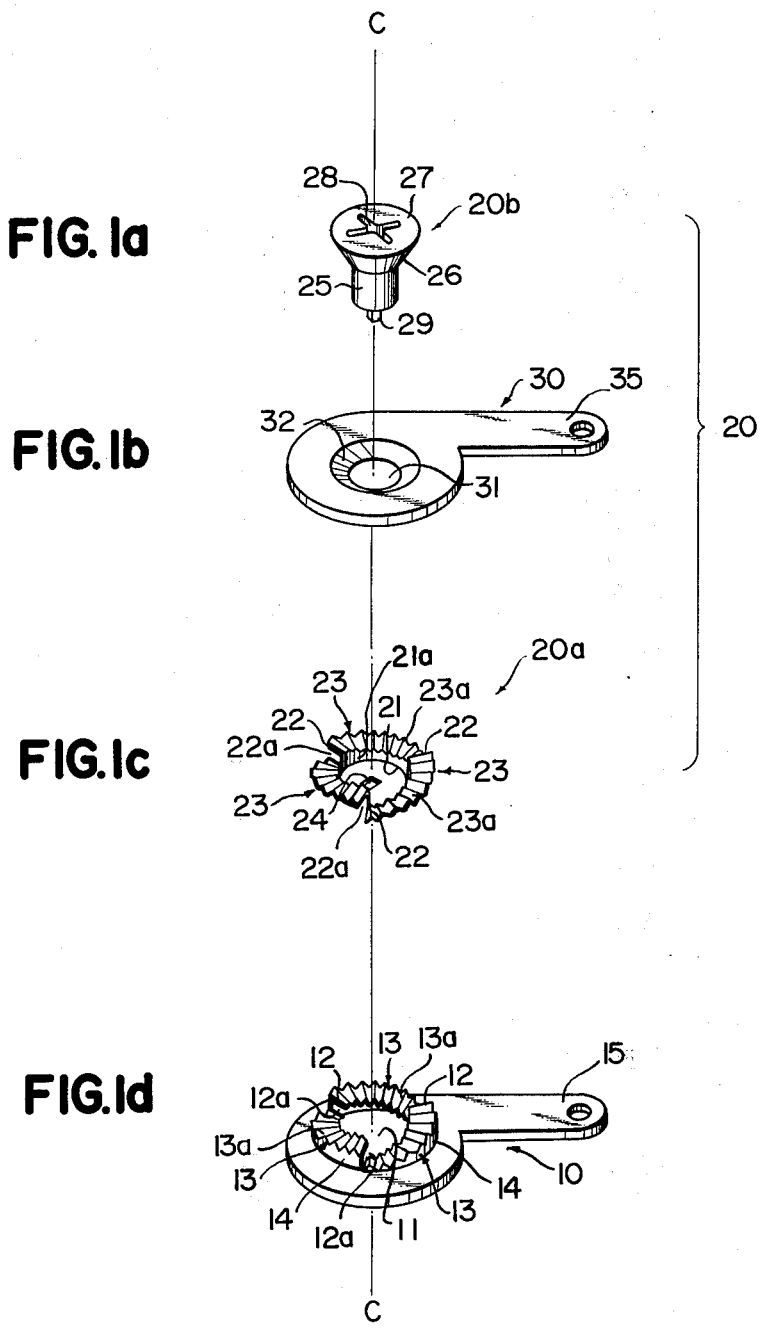
FIGS. 1*a* to 1*d* are perspective views of the component elements of the present invention as they are shown exploded in the axial direction of C—C of the coupling.

The coupling is provided with a bottom mounting plate 10 shown in FIG. 1*d* in which an inwardly directed discontinuous fin threaded disc 13 is located. The disc 13 comprises a set of radially inwardly directed segments 13*a* on which a series of indentations are formed providing a double surface toothed rack, varying in height gradually in the direction of intended rotation. The segments are joined together by a cylindrical outer wall 14 and arranged in an annulus separated by radial slits 12, 12, 12 (three in the drawing) extending at an equal angular distance, inwardly from the circumference of said circular hole 11. The higher end of each segment 13*a* provided with a fitting edge 12*a*, so that an axial opening is formed between the first tooth of one segment and the last tooth of the adjacent segment. The annular wall 14 is adapted to arrange segments uniformly above the surface of the plate 10. A strip-shaped lateral extension 15 is provided on the plate 10. The purpose of the wall 14 and extension 15 are explained latter in connection with FIG. 2 to 4.

The coupling is completed by mounting a stud assembly generally indicated by the numeral 20 comprising an externally directed fin threaded disc 20*a*, a mounting plate 30 and a fastening stud 20*b*. The externally directed discontinuous thread fin disc 20*a* shown in FIG. 1*c* is formed of a bottom wall 21 and a cylindrical wall 21a which is provided circumferentially with a set of externally directed segments 23, separated by slits 22, and fitting edges 22*a*, both of which are of the same shape and size as the corresponding elements on inwardly directed disc 13 and are thus arranged to be threadedly fitted therewith through said fitting edges 12*a*, respectively. A square hole 24 is formed in the center of the central circular portion 21 of said external-threaded disc 20*a*. Each of the externally directed segments 23 is provided with indentations 23*a* which form a rack detent means adapted to engage with the corresponding indentations formed on the segments 13*a* shown in FIG. 1*d*. At least one of said mutually engaging internaland and external-directed fin discs 13 or 20*a* is made elastic.

It will be apparant that the plate 13 forms a discontinuous threaded member open from the interior while the disk 20 forms a similar member open from the exterior, the segments of which constitute the thread elements which rotatively interengage on relative rotation of the discs. The threads include interengaging racks or teeth which provide sure firm detent means preventing disengagement of the threads formed by the segments under normal use. The coupling thus provides a generally secure and relatively thin screw type coupling.

Figure 2:
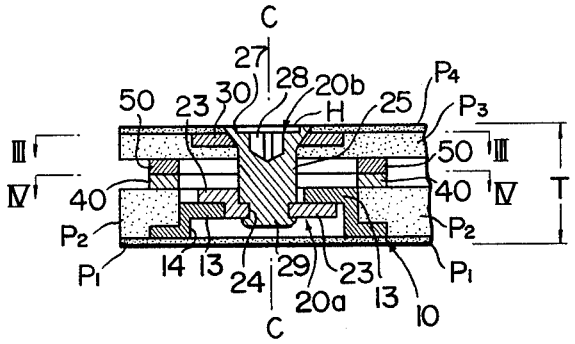
FIG. 2 is a sectional view of a swingable thin gage electrical cord connector embodying the present invention.

The stud 20*b* shown in FIG. 1*a* comprises a columnar body portion 25 and an enlarged frusto-conical head portion 26 having a flat top 27 which has formed in it a cruciform slot 28 for receiving an end of a turning tool such as a screw driver. This stud is assembled with the mounting block 30, which is shown in FIG. 1*b* such that the columnar portion 25 and the conical sloping surface 26 of the stud will fit within the corresponding guide hole 31, which also has a sloping surface 32, of said block 30. A small square protuberance 29 projects from the bottom end face of the columnar body portion 25. The protuberance 29 is inserted into the corresponding square hole 24 in disc 20*a* shown in FIG. 1*c*, the stud is fixed vertically against axial movement by a suitable key slot and key arrangement as seen in FIG. 2.

The mounting block 30, which is shown as a plate structure in FIG. 1*b*, has flat upper and lower surfaces and is assembled in loose fit within the stud assembly 20 between the stud 20*b* and the disc 20*a*. A strip-shaped extension 35 projects laterally from the mounting block 30, such extension being similar to the extension 15 of the internal-threaded plate 10 shown in FIG. 1*d*.

The present invention operates as follows.

Firstly, the stud assembly 20 loosely fitted with the mounting block 30 is centered with the bottom plate assembly 10 along the axial line C—C and then the driving end of a turning tool such as a screw driver, is inserted into the slot 28 and pressingly turned in the fastening direction, whereby both internaland external-fin discs segments 13 and 23 become threadedly engaged with each other through the respective engaging edges 12*a* and 22*a*. Fixing of the mounting block 30 is rotatably secured by engagement of the interlocking rack or detent means which screw together along the gradual pitch of each segment and lock together by interengagement of the conforming indentations. For unfastening and separating the coupling, the turning tool may be turned in the opposite (unfastening) direction.

Figure 3:
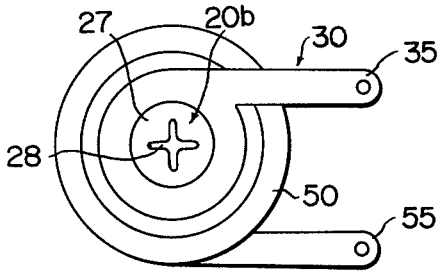
FIGS. 3 and 4 are sectional views taken on the lines III—III and IV—IV, respectively, and in the direction of arrows of FIG. 2, with the insulating plate being omitted.
Figure 4:
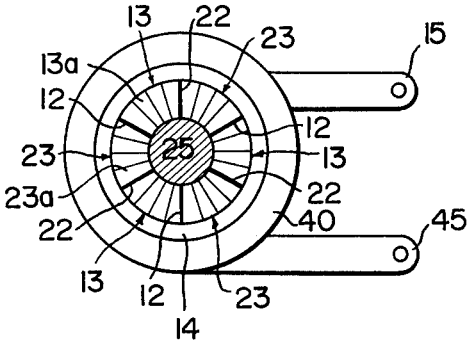

In FIGS. 2 to 4, there is shown a coupling enbodying the present invention adapted for use as a detachable pivot in a swingable thin-gage electrical cord connector (or which can also serve as a plug receptacle). In these figures, the parts equivalent to those shown in FIGS. 1*a* to 1*d* are assigned the same reference numerals and the further descriptions omitted, and in the following discussion of this embodiment, only the parts differing from those already shown are described.

In FIG. 2, the bottom mounting plate 10 serves as an external conductor and the lower internally directed fin disc 13 and the upper externally directed fin disc 23 are embedded in an insulator block P2 in the portion below the line IV—IV. Above the insulating block P1 is stacked a pair of sliding circular conductor plates 40 and 50 respectively. The plates are securely arranged on the upper surface of the insulating plate P2 so that they are centered about the axis C—C and each is provided with an extension 45 and 55 respectively. In the portion above the line IV—IV, the mounting block 30 made from a conductor material is assembled in loose fit with the stud 20*b* of the stud assembly 20. Both are embedded within insulating blocks P3 and P4.

The insulating block P4 is provided with a hole H for inserting the turning tool, such hole being kept suitably closed by insulating material when not in use. Numerals 15, 35, 45 and 55 in FIGS. 3 and 4 indicate elongated extensions of the conductor plates 10, 30, 40 and 50, respectively, such extensions being designed to serve as conductive terminals.

This cord connector is constructed as described above and its detachable pivot is constituted from a conductormade coupling of the present invention as described in connection with FIG. 1*a*–1*d* so that the paired conductive terminals 15 and 35, and 45 and 55, are swingable about said pivot to effect conductive contact respectively, allowing the assembly to act as a swingable cord connector or as a plug receptacle. Further, as an additional advantage of the present invention, the entire assembly can be manufactured with an extremely small thickness T as shown in FIG. 2.

Also secure maintenance of the pivot is ensured by the interlocking engagement of the segments 13*a* and 23*a*. Moreover, mounting and detachment can be accomplished with ease and quickly by operating a single ordinary turning tool from only one side of the cord connector. Also, in case such a cord connector is to be used at the cord outlet in a doormat which includes electric contacts for an automatic door for a building, it is possible to use a thin mat since the thickness T of the assembly can be reduced to the order of 4 to 5mm. Further, in the conventional devices of this type, internal breakage of wire would often take place near the cord outlet during cleaning or movement of the mat, and in the event of such breakage it was necessary to tear out the cord and/or mat to locate the trouble spot. However the connector adapted with the present invention reduces the chance of breaking wire, as flexure or distortion of the cord is released or permitted to some extent, due to the swingable arrangement of the connector. Further, as the connector can be attached and detached with ease, one can easily judge whether the trouble (such as wire breaking) is present in the internal wiring of the mat or in the external cord, thus allowing great saving of labor and time for repair and reduced cost for maintenance.

The outstanding effects of the present invention are summarized in the following:

1. As the thickness in the axial direction can be reduced, the strict condition of limited space can be met and also the ultimate object to which the present invention is applied can itself be reduced in thickness.
2. As the thread engaged portion (i.e. the segment) is lamellar and wide in area and also includes the detent means, secure fixing is ensured.
3. No special tool or highly skilled technique is required for coupling or uncoupling, and fixing and detachment can be accomplished with ease by merely turning the screw less than 180° (less than 120° in the shown embodiment) from only one side of the cord connector.

What is claimed is:

1. A threaded coupling comprising a first disc element having a plurality of equi-spaced radial slits dividing said first disc element into a plurality of circumferential segments each extending in a radial direction and having in the circumferential direction progressively increasing axial height, said radial slits in said first disc element forming junctures between adjacent ones of said segments such that the adjacent edges of the segments are spaced at different elevations, said first disc element thus presenting a first thread, a second disc element provided with radial slits equal in number to those of said first disc element dividing said second disc element into a plurality of circumferential segments, each of said segments of said second disc extending in a radial direction opposite to that of the first disc, the slits of said second disc forming junctures between adjacent segments such that the adjacent edges of the segments thereof are spaced at different elevations, each of the segments of said second disc element having in the circumferential direction a progressively increasing axial height thus presenting a second thread adapted to intermesh with said first thread, a mounting block element positioned in juxtaposed relation to one of said disc elements, said mounting block having a central opening therein, a rotatable stud element having a columnar portion dimensioned to extend through the central opening in said mounting block element in engagement with said one disc element and, means for keying said stud to said one disc to conjointly rotate the same relative to the other disc, whereby the rotation of said one disc causes said thread elements to intermesh and secure said mounting block between said stud and said disc elements.

2. The threaded coupling according to claim 1 wherein said one of said disc elements is provided with a bottom wall having a shaped opening therein and said stud is provided with an enlarged head at one end and a depending projection at the other end thereof having a configuration complementary to the opening in said one disc element thereby forming said means for keying said stud element to said one disc.

3. A threaded coupling according to claim 2, wherein the upper face of said stud head is provided with a recessed area to facilitate rotation of said stud element.

4. A threaded coupling according to claim 2, wherein the opening in said one disc element is generally square.

5. A threaded coupling according to claim 2, wherein the opening in said mounting block element is countersunk and the head of said stud element is provided with a conical surface for seating in said countersunk opening.

6. A threaded coupling according to claim 2, wherein first and second members are provided each formed of electrically insulative material, said first disc element being formed of an electrically conductive material and positioned between said insulative plates, a first annular conductor plate being secured to the upper surface of the first of said insulative plates, third and fourth members formed of electrically insulative material positioned on opposed sides of said mounting block element, said fourth insulative member having a second annular conductor plate secured to the lower surface thereof in sliding engagement with said first annular conductor plate, said third and fourth insulative members having aligned central apertures such that the columnar portion of said stud element may be inserted therethrough to permit the depending projection of said stud element to fit within the opening of said second disc element to effectuate rotation of same, the enlarged head of said stud element serving to retain said third insulative member in position therebeneath, said first and second annular conductor plates and said disc elements and mounting block element being provided with elongated extensions projecting therefrom adapted to serve as conductive terminals, the extensions of said first and second annular conductor plates being rotatable angularly together with the conductor plates associated therewith.

7. A threaded coupling according to claim 1, wherein the contiguous surfaces on said disc elements are provided with cooperable detent means for maintaining the relative positions thereof.

8. A threaded coupling according to claim 1, wherein each of said mounting block and the other one of said disc elements are provided with at least one similarly oriented lateral extension.

9. The threaded coupling according to claim 8 wherein said lateral extensions are formed of conductive material.

10. A threaded coupling according to claim 1, wherein said mounting block element is a plate member of substantially the same thickness as said first disc element.

11. A threaded coupling according to claim 1, wherein said first disc element includes an upstanding annular wall and said circumferentially extending segments extend radially inwardly therefrom, said second disc element including an upstanding annular wall and the circumferentially extending segments thereof extending radially outwardly of said wall.

12. A threaded coupling according to claim 1 wherein each of said segments are steped to form a rock in the direction of the progressively increasing height.

* * * * *